US006263539B1

(12) United States Patent
Baig

(10) Patent No.: US 6,263,539 B1
(45) Date of Patent: Jul. 24, 2001

(54) CARPET/FLOOR CLEANING WAND AND MACHINE

(76) Inventor: Taf Baig, 1119 N. Washington St., Naperville, IL (US) 60563

( * ) Notice: Subject to any disclaimer, the term of this patent is extended or adjusted under 35 U.S.C. 154(b) by 0 days.

(21) Appl. No.: 09/471,832

(22) Filed: Dec. 23, 1999

(51) Int. Cl.[7] ..... A47L 9/04
(52) U.S. Cl. ..... 15/322; 15/321; 15/415.1
(58) Field of Search ..... 15/321, 322, 354, 15/361, 362, 415.1

(56) References Cited

U.S. PATENT DOCUMENTS

| | | | | |
|---|---|---|---|---|
| 729,624 | | 6/1903 | Mason . | |
| 983,988 | | 2/1911 | Foster et al. . | |
| 1,176,990 | | 3/1916 | Scherff . | |
| 1,394,789 | | 10/1921 | Prell . | |
| 1,596,041 | | 8/1926 | Young . | |
| 1,670,934 | | 5/1928 | Keefer . | |
| 1,687,283 | | 10/1928 | Deutscher . | |
| 2,293,722 | | 8/1942 | Erickson . | |
| 2,333,729 | | 11/1943 | Terry . | |
| 2,334,914 | | 11/1943 | Erickson . | |
| 2,622,254 | | 12/1952 | Mendelson . | |
| 2,807,824 | * | 10/1957 | Coons | 15/361 |
| 3,699,607 | | 10/1972 | Putt . | |
| 3,711,891 | * | 1/1973 | Conway | 15/321 |
| 3,774,262 | * | 11/1973 | Anthony et al. | 15/345 |
| 3,871,051 | * | 3/1975 | Collier | 15/321 |
| 4,009,728 | * | 3/1977 | Parise | 15/321 |
| 4,164,055 | * | 8/1979 | Townsend | 15/321 |
| 4,498,214 | | 2/1985 | Oxel . | |
| 4,696,074 | * | 9/1987 | Cavalli | 15/321 |
| 5,060,342 | * | 10/1991 | Brazier | 15/322 |
| 5,088,149 | * | 2/1992 | Berg et al. | 15/322 |
| 5,357,650 | * | 10/1994 | Finley | 15/415.1 |
| 5,483,726 | | 1/1996 | Blase et al. . | |
| 5,542,147 | | 8/1996 | Merten . | |
| 5,555,599 | * | 9/1996 | Markley | 15/322 |
| 5,603,139 | | 2/1997 | Alazet . | |
| 5,697,119 | | 12/1997 | Mussalo . | |
| 5,752,289 | * | 5/1998 | Collins | 15/322 |
| 5,819,366 | * | 10/1998 | Edin | 15/322 |
| 5,891,198 | * | 4/1999 | Pearlstein | 15/322 |
| 5,933,913 | | 8/1999 | Wright et al. . | |
| 6,151,748 | * | 11/2000 | Earhart et al. | 15/322 |
| 6,152,151 | * | 11/2000 | Bolden et al. | 15/322 |

* cited by examiner

*Primary Examiner*—Terrence R. Till
(74) *Attorney, Agent, or Firm*—Charles F. Meroni, Jr.; Meroni & Meroni, P.C.

(57) ABSTRACT

The carpet/floor cleaning wand has a vacuum tube with a first section extending roughly parallel to the ground and a second section angled in an upwards direction from the first section. A vacuum hose connects the vacuum tube to a vacuum source. A vacuum head is connected to the first section of the vacuum tube, the vacuum head having bristles therearound and a squeegee attached to the front of the vacuum head. A wheel assembly is releasably mounted onto the vacuum tube. A brush assembly having a motor and a brush is mounted behind the vacuum head. A spray assembly is comprised of a spray manifold mounted behind the vacuum head, a plurality of spray heads emanating from the spray manifold, a fluid feeding tube extending from the spray manifold and to a flow regulator.

22 Claims, 5 Drawing Sheets

CARPET/FLOOR CLEANING WAND AND MACHINE

FIELD OF THE INVENTION

The present invention relates to a cleaning wand and machine for use in cleaning carpets.

DESCRIPTION OF THE PRIOR ART

In order to reduce the time and the effort involved with cleaning large carpeted areas, professional carpet cleaners typically utilize large truck based commercial carpet cleaning machines or slightly smaller portable carpet cleaning machines. These machines are typically stored in a truck or a central area and they use long hoses and fluid lines to provide vacuum and cleaning fluid to a cleaning wand. These cleaning wands are typically comprised of a long tubular pipe with a vacuum head having a vacuum channel and a spray head attached thereto. Typically these cleaning wands have no brushes for scrubbing the carpet/floor surface, or at least has only a stationary brush which only moves when the head is moved.

The problem with these large commercial carpet cleaning machines lies in the designs of their cleaning wands. The cleaning wands typically can only clean when the wand is being pulled backwards. Consequently, the wand is constantly moved forwards and backwards in a lateral direction in order to position and reposition the wand.

These commercial carpet cleaning machines typically generate tremendous vacuum pressure which is then applied to the carpet through the cleaning wand. The lateral movement of the cleaning wand becomes quite difficult at times. This vacuum pressure coming from the commercial carpet cleaning machines usually causes the cleaning wand to dig in the carpet making lateral movement difficult, especially in thick carpets. In order to move the cleaning wand in a lateral direction, the vacuum head must at times be moved simultaneously in a horizontal and vertical direction, the vertical movement to offset the vacuum pressure which causes the vacuum head to dig into the carpet.

As a result, there is a lot of wasted energy positioning and repositioning the cleaning wand. The cleaning of large areas of carpeting has long been a time consuming and arduous task. The substantial effort which is needed in order to push and pull the cleaning wand across a carpet can rapidly fatigue a person using the cleaning wand. In a commercial carpet cleaning operation, where large areas of carpeting are cleaned daily, fatigue will significantly limit the amount of carpeting cleaned daily.

A number of small devices for cleaning carpet and floors have been developed in the prior art. These devices spray the carpet or floor with a cleaning fluid and subsequently extract fluid and dirt from the carpet or floor through the use of a vacuum. However, these smaller carpet and floor cleaning systems are ineffective for use with large areas of carpeting or flooring due to the need to constantly refill the machine with cleaning fluid and the need to constantly remove the extracted fluid from the machine.

Even with the problems involved with the cleaning wands, the truck based commercial carpet cleaning systems are still considered the most effective means for the cleaning of large areas of carpet. Consequently, there is a need to improve the design of the cleaning wand in order to minimize the effort of using the cleaning wand with these truck based system. and also with the smaller portable units.

Accordingly, there is a need for a carpet/floor cleaning wand which is easily maneuvered across a carpet or floor surface.

Accordingly, there is a need for a carpet/floor cleaning wand which scrubs a carpet or floor surface removing the need to manually scrub.

Accordingly, there is also a need for a carpet/floor cleaning wand machine which alleviates some of the stresses and strains inflicted on the human body while carpet cleaning.

The present invention is a carpet/floor cleaning wand and machine for use in a commercial carpet cleaning setting where large areas of carpet are cleaned.

As will be described in greater detail hereinafter, the present invention solves the aforementioned and employs a number of novel features that render it highly advantageous over the prior art.

SUMMARY OF THE INVENTION

Accordingly, it is an object of this invention to provide a carpet/floor cleaning wand and machine for use in a commercial carpet cleaning setting where large areas of carpet are cleaned.

Accordingly, it is a further object of this invention to provide a carpet/floor cleaning wand which scrubs a carpet or floor surface removing the need to manually scrub.

Accordingly, it is a further object of this invention to provide a carpet/floor cleaning wand which reduces the stresses and strains on the human body associated carpet cleaning.

To achieve these objectives, and in accordance with the purposes of the present invention the following carpet/floor cleaning wand is presented.

The carpet/floor cleaning wand has a vacuum tube with a first section extending roughly parallel to the ground and a second section angled in an upwards direction from the first section. A vacuum hose connects the vacuum tube to a vacuum source. A vacuum head is connected to the first section of the vacuum tube. The vacuum head has a vacuum chamber therein receiving vacuum pressure from the vacuum tube.

A wheel assembly is releasably mounted onto the vacuum tube. The wheel assembly raises the first section of the vacuum tube to a height, preferably 4 to 6 inches off the carpet, enabling the wheel assembly to function as a fulcrum upon which the vacuum head is raised or lowered onto the carpet. The vacuum head is raised or lowered by vertically adjusting the position of the second section of the vacuum tube. The wheel assembly also providing support during the lateral movement of the cleaning wand.

A brush assembly having a motor and a brush is mounted behind the vacuum head. The brush is cylindrical and has bristles arranged in helical fashion. The brush is rotatively mounted to the vacuum head and coupled to the motor. The motor rotates the brush, the brush then agitating the carpet allowing spots and dirt to be removed from the carpet.

A spray assembly is comprised of a spray manifold mounted behind the vacuum head, a plurality of spray heads emanating from the spray manifold, a fluid feeding tube extending from the spray manifold and to a flow regulator. A connecting means extends from the flow regulator. The connecting means connects the spray assembly to a pressurized fluid hose delivering pressurized cleaning fluid from a pressurized fluid pump.

A handle assembly is releasably mounted onto the second section of the vacuum tube. In the preferred embodiment, the handle assembly has a grip portion spanning across a U-shaped bar. The grip portion has an outer surface made of a material capable of molding to the contours of a hand such as a soft plastic, gel or leather. A handle mounting means, preferably a C-clamp releasably mounts the U-shaped bar onto the second section of the vacuum tube, allowing the handle assembly to be freely positionable along the second section of the vacuum tube.

Other objects, features, and advantages of the invention will become more readily apparent upon reference to the following description when taken in conjunction with the accompanying drawings.

DESCRIPTION OF THE PREFERRED EMBODIMENT

Figure 1:
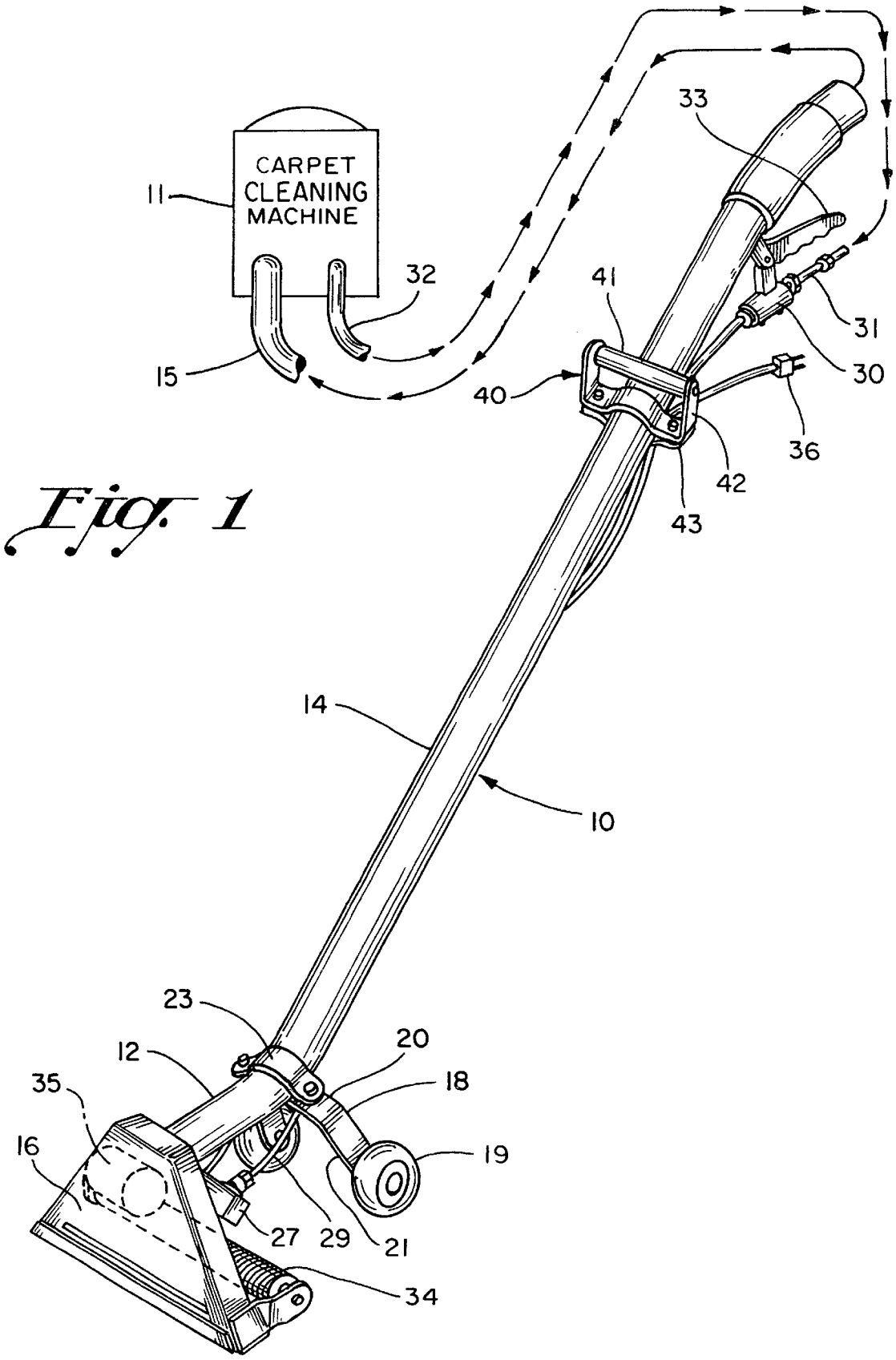
FIG. 1 is a side perspective of my carpet/floor cleaning wand revealing features.

Referring to FIG. 1, the present invention is a carpet/floor cleaning wand 10 for use with a carpet cleaning machine 11. The carpet/floor cleaning wand has a vacuum tube 13 with a first section 12 extending roughly parallel to the ground and a second section 14 angled in an upwards direction from the first section 12. The vacuum tube 13 is preferably made of a light metallic material, but a rigid plastic material may also be used. A vacuum hose 15 connects the vacuum tube 13 to a vacuum source within the carpet cleaning machine 11.

Figure 6:
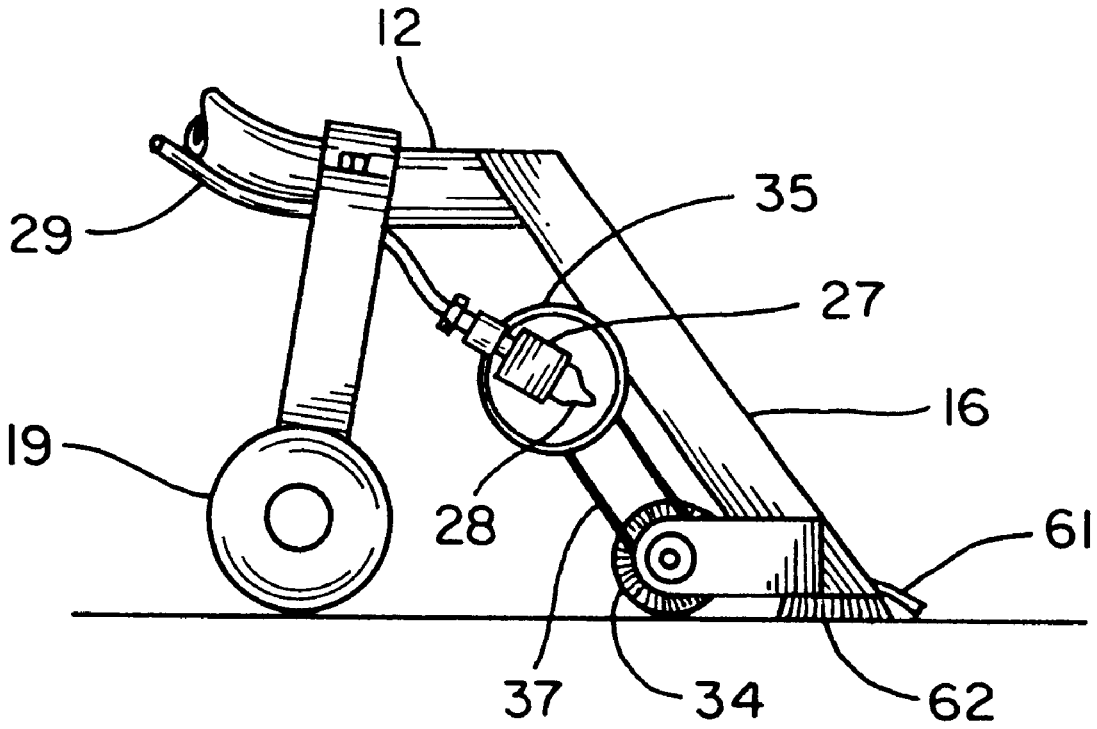
FIG. 6 is a side view of a second embodiment of the vacuum head.

Referring to FIGS. 1, 3, 5 and 6, a vacuum head 16 is operatively connected to the first section 12 of the vacuum tube 13. A vacuum channel 17 within the vacuum head receives vacuum pressure from the vacuum tube 13 and applies the vacuum pressure to the carpet removing cleaning fluid and dirt from the carpet. Referring to FIG. 6, in a second embodiment of the vacuum head, one designed primarily for cleaning floors, the vacuum channel has an opening having bristles 62 therearound and a squeegee 61 mounted to the front of the vacuum head 16. The bristles and the squeegee aiding in the retrieval of the water by the vacuum channel, and aiding in the scrubbing of the floor surface.

Figure 2:
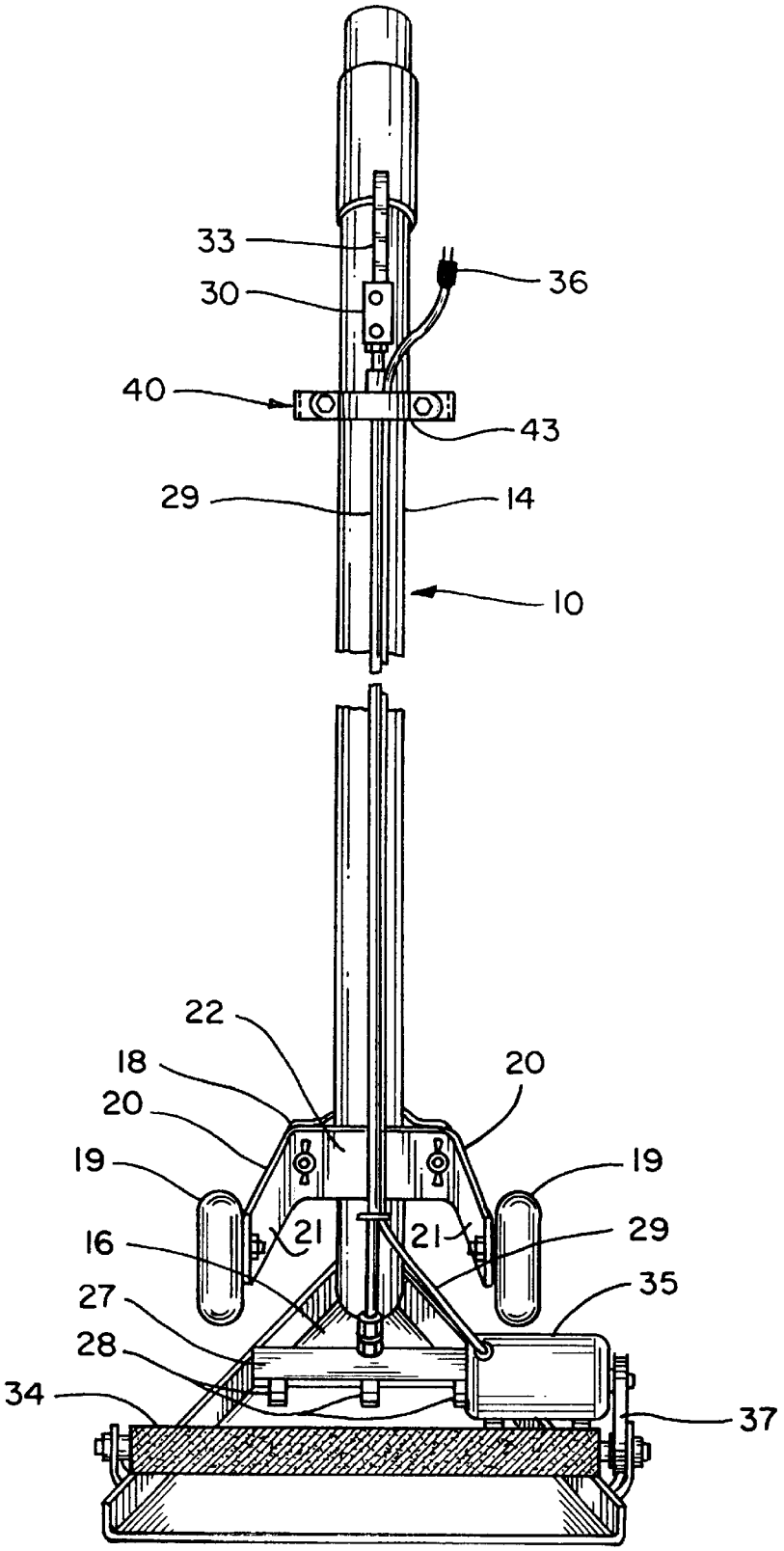
FIG. 2 is a rear view of the carpet/floor cleaning wand shown in FIG. 1.
Figure 3:
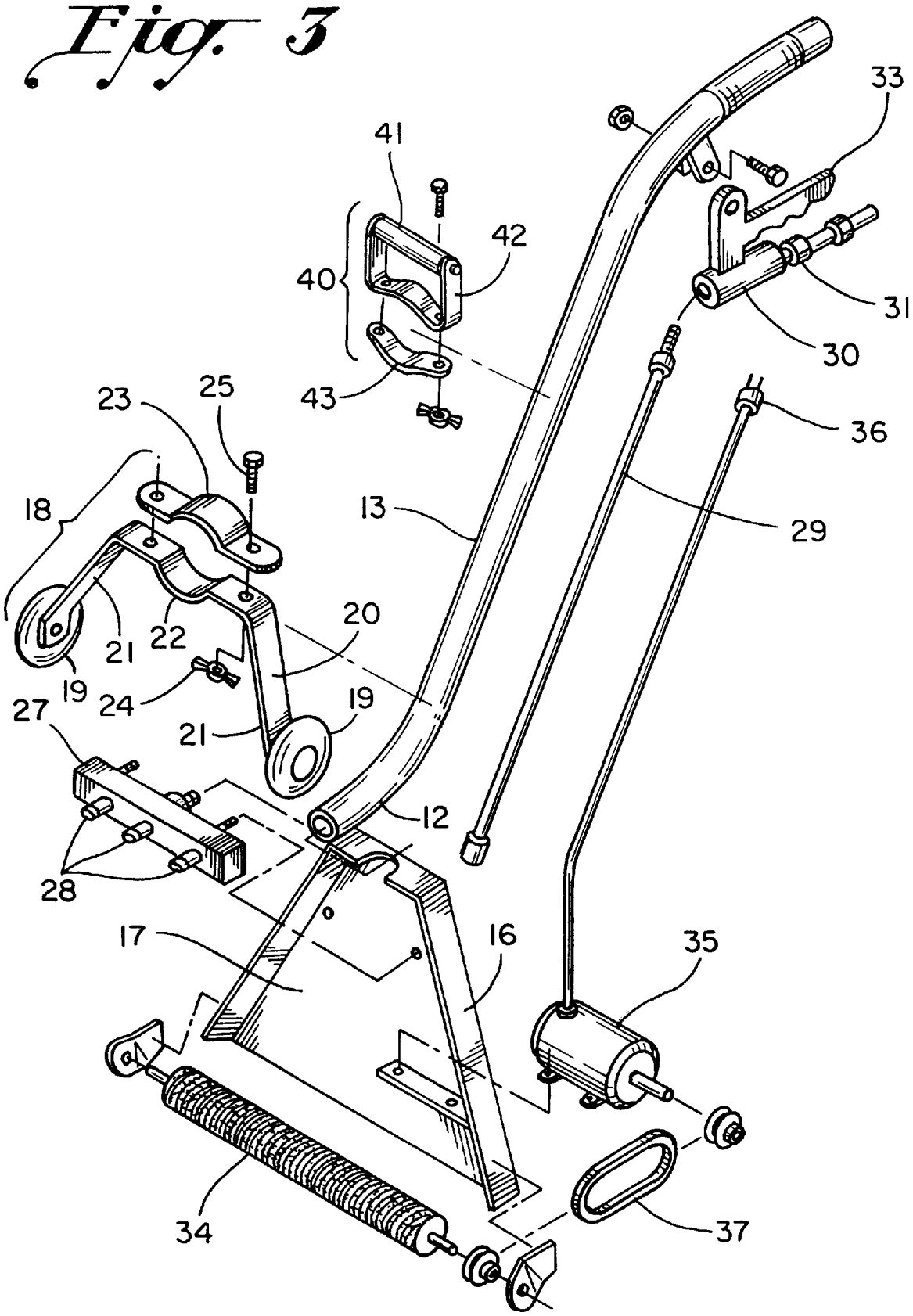
FIG. 3 is an exploded view of the carpet/floor cleaning wand in FIG. 1 highlighting the wheel assembly and the handle assembly in its preassembled state.
Figure 4:
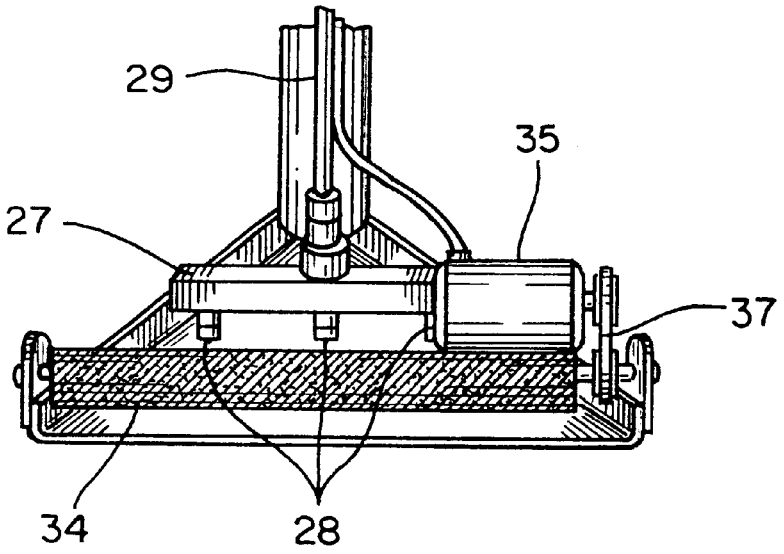
FIG. 4 is a rear view of the vacuum head on my carpet/floor cleaning wand revealing features.
Figure 5:
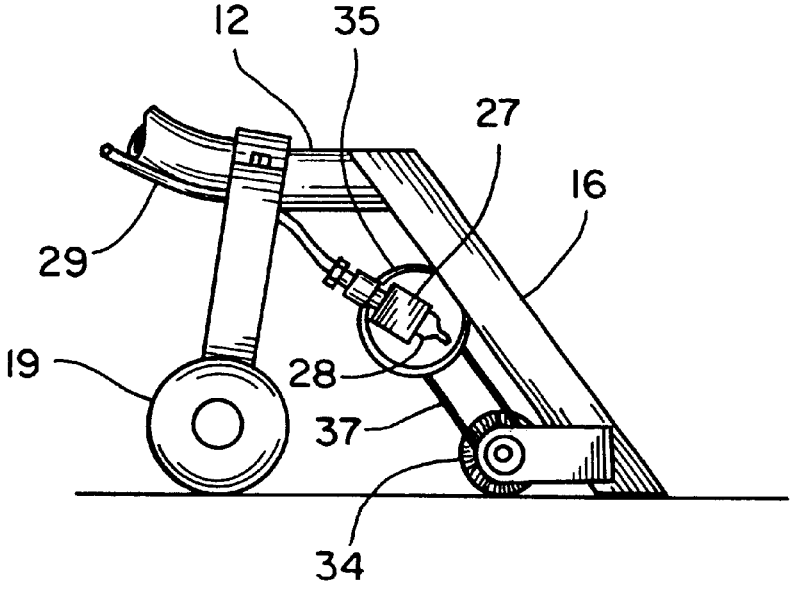
FIG. 5 is a side view of the vacuum head in FIG. 4.

Referring to FIGS. 1, 2, 3, a wheel assembly 18 is releasably mounted onto the vacuum tube 13. In the preferred embodiment, the wheel assembly has a pair of wheels 19, and a U-shaped wheel bar 20 having a pair of longitudinal sides 21 and a horizontal side 22, the horizontal side 22 having a rounded middle portion wherein the vacuum tube 13 rests. Each wheel 19 is rotatively mounted on opposite longitudinal sides 21 of the U-shaped wheel bar 20. A mounting means releasably connects the U-shaped wheel bar 20 to the vacuum tube 13, allowing the U-shaped wheel bar 20 to be adjustably positioned along the vacuum tube 13. The mounting means is preferably a mounting bar 23 having a rounded middle portion. The mounting bar 23 is positioned so that the rounded middle portion is overlaying the vacuum tube 13, and the mounting bar 23 is relatively parallel to the horizontal side 22 of the U-shaped wheel bar 20 positioned beneath the vacuum tube 13. The mounting bar 23 is then connected to the U-shaped wheel bar 20, preferably by a pair of washer 24 and screws 25, clamping onto the vacuum tube 13 sandwiched therebetween.

The wheel assembly 18 raises the first section 12 of the vacuum tube 13 to a height, preferably 4 to 6 inches off a surface, enabling the wheel assembly 18 to function as a fulcrum upon which the vacuum head 16 is raised or lowered onto the carpet. In the past, as was necessitated by the prior art, a person would exert a tremendous amount of energy providing a vertical lift, in order to prevent the vacuum head 16 from digging into the carpet or to lift the vacuum head off the carpet to reposition the vacuum head. Instead of having to provide a vertical force to lift the vacuum head off the carpet, the vacuum head can now be raised or lowered by slightly adjusting the vertical position of the second section 14 of the vacuum tube 13. The wheel assembly 18 also provides vertical support during the lateral movement of the cleaning wand, allowing the cleaning wand 10 to move more easily in the lateral direction.

Referring to FIGS. 1, 2, 3, 4, 5, and 6 a spray assembly comprised of a spray manifold 27 mounted behind the vacuum head 16, a plurality of spray heads 28 emanating from the spray manifold 27, a fluid feeding tube 29 extending from the spray manifold and to a flow regulator 30. A connecting means 31 extends from the flow regulator 30. The connecting means 31 connects the spray assembly to a pressurized fluid hose 32 delivering pressurized cleaning fluid from a pressurized fluid pump within the carpet cleaning machine 11.

Referring 1, 2, and 3, in the preferred embodiment, the flow regulator is grip operated. By compressing a hand grip 33, a valve in the grip operated flow controller 30 opens releasing pressurized cleaning fluid into the fluid feeding tube 29 then through the spray manifold 27 and eventually through the spray head 28. The spray heads 28 are positioned on the spray manifold 27 to deliver a pressurized stream of fluid behind the vacuum head 16. If the cleaning wand 10 is moving in a backwards direction, the fluid is then immediately extracted from the carpet by the vacuum head 16.

Referring to FIGS. 2, 3, 4 and 5, 6 a brush assembly having a motor 35 and a brush 34 is mounted behind the vacuum head 16. The brush 34 is rotatively mounted to the vacuum head 16 and coupled to the motor 35. The motor 35 rotates the brush 34, preferably in a counter clockwise direction preferably at a rate of around 1000 to 2000 RPM. In the preferred embodiment, the motor 35 is electrically powered, a power cord 36 is extended from the motor to the second section 14 of the vacuum tube 13. The motor is preferably coupled to the brush by means of a belt 37.

The brush 34 is preferably cylindrical and has bristles arranged in helical fashion in order to lift and separate the strands of carpet. The brush 34 agitates the carpet beneath the brush allowing the pressurized cleaning fluid coming from the spray heads to penetrate deeper into the carpet. When used on a floor surface the brush acting to scrub the floor surface.

Referring to FIGS. 1, 2, and 3, a handle assembly 40 is releasably mounted onto the second section 14 of the vacuum tube 13. In the preferred embodiment, the handle assembly 40 has a grip portion 41 spanning across a U-shaped bar 42. The grip portion 41 has an outer surface made of a material capable of molding to the contours of a hand such as a soft plastic,gel or leather, in order to reduce the stress and strains of handling the cleaning wand. A handle mounting means 43, releasably mounts the U-shaped bar 42 onto the second section 14 of the vacuum tube 13, allowing the handle assembly 40 to be freely positionable along the second section 14 of the vacuum tube 13.

Referring to FIG. 3, in an alternative embodiment, the wheel assembly 18, the handle assembly 40, and the brush assembly are pre-packaged together or separately in a retro-fit kit. This retro-fit kit includes all of the components necessary in order to install the wheel assembly, the handle assembly, and the brush assembly or any combination thereof onto an existing cleaning wand or other similarly shaped cleaning instruments. The retrofit kit is arranged so that the wheel assembly 18, the handle assembly 40, and the brush assembly lay in the package pre-assembled requiring only to be mounted onto an existing cleaning wand or other similarly shaped cleaning instruments.

The invention described above is the preferred embodiment of the present invention. It is not intended that the novel device be limited thereby. The preferred embodiment may be susceptible to modifications and variations that are within the scope and fair meaning of the accompanying claims and drawings.

I claim:

1. A cleaning wand for use with a carpet cleaning machine, the carpet/floor cleaning wand comprising:

a vacuum tube, the vacuum tube having a first section extending roughly parallel to the ground and a second section angled in an upwards direction from the first section;

a vacuum head, the vacuum head connected to the vacuum tube and having a vacuum channel therein, the vacuum channel receiving vacuum pressure from the vacuum tube;

a wheel assembly, the wheel assembly having a pair of wheels, each wheel rotatively mounted on opposite sides of a U-shaped wheel bar, a mounting means releasably connects the U-shaped wheel bar to the vacuum tube allowing the U-shaped wheel bar to be adjustably positioned on the vacuum tube, the wheel assembly providing a fulcrum upon which the vacuum head is raised or lowered onto a surface by vertically adjusting the position of the second section of the vacuum tube;

a brush assembly, the brush assembly having a motor and a brush mounted behind the vacuum head, the brush rotatively mounted and coupled to the motor, the motor driving the brush to rotate; and a spray assembly, the spray assembly having a spray manifold, a plurality of spray heads emanating from the spray manifold, the spray heads positioned to deliver a pressurized stream of fluid in between the vacuum head and the brush, a fluid feeding tube extends from the spray manifold to a grip operated flow regulator, a means for connecting the spray assembly to a pressurized fluid pump extending from the grip operated flow regulator.

2. The cleaning wand in claim 1 further comprising a handle assembly mounted onto the second section of the vacuum tube, the handle assembly having a grip portion capable of molding to the contours of a hand and a handle mounting means capable of releasably mounting onto the second section of the vacuum tube.

3. The cleaning wand in claim 1 wherein the motor rotates the brush at a rate of 1000–2000 RPM.

4. The cleaning wand in claim 1 wherein the brush has bristles arranged in helical fashion across and around the brush.

5. A cleaning wand for use with a carpet cleaning machine, the carpet cleaning wand comprising:

a vacuum tube, the vacuum tube having a first section extending roughly parallel to the ground and a second section angled in an upwards direction from the first section;

a vacuum head, the vacuum head connected to the vacuum tube and having a vacuum channel therein, the vacuum channel receiving vacuum pressure from the vacuum tube; and a wheel assembly, the wheel assembly having a pair of wheels, each wheel rotatively mounted on opposite sides of a U-shaped wheel bar, a mounting means releasably connects the U-shaped wheel bar to the vacuum tube allowing the U-shaped wheel bar to be adjustably positioned on the vacuum tube, the wheel assembly providing a fulcrum upon which the vacuum head is raised or lowered onto a surface by vertically adjusting the position of the second section of the vacuum tube.

6. The cleaning wand in claim 5 further comprising a brush assembly, the brush assembly having a motor and a brush mounted behind the vacuum head, the brush rotatively mounted and coupled to the motor, the motor driving the brush to rotate in a counter clockwise direction.

7. The cleaning wand in claim 6 wherein the motor rotates the brush at a rate of 1000–2000 RPM.

8. The cleaning wand in claim 7 wherein the brush has bristles arranged in helical fashion across and around the brush.

9. The cleaning wand in claim 8 further comprising a spray assembly, the spray assembly having a spray manifold, a plurality of spray heads emanating from the spray manifold, the spray heads positioned to deliver a pressurized stream of fluid in between the vacuum head and the brush, a fluid feeding tube extends from the spray manifold to a grip operated flow regulator, a means for connecting the spray assembly to a pressurized fluid pump extending from the grip operated flow regulator.

10. The cleaning wand in claim 8 further comprising a handle assembly mounted onto the second section of the vacuum tube, the handle assembly having a grip portion capable of molding to the contours of a hand and a handle mounting means capable of releasably mounting the handle assembly onto the second section of the vacuum tube.

11. A carpet cleaning machine, the carpet cleaning machine comprising:

a vacuum source;

a vacuum tube, the vacuum tube having a first section extending roughly parallel to the ground and a second section angled in an upwards direction from the first section, a vacuum hose connecting the vacuum tube to the vacuum source;

a vacuum head, the vacuum head connected to the vacuum tube and having a vacuum channel therein, the vacuum channel receiving vacuum pressure from the vacuum tube; and a wheel assembly, the wheel assembly having a pair of wheels, each wheel rotatively mounted on opposite sides of the wheel assembly, the wheel assembly adjustably mounted onto the vacuum tube allowing the wheel assembly to be adjustably positioned on the vacuum tube the position of the wheel assembly affecting the vertical height of the second section of the vacuum tube, the wheel assembly functions as a fulcrum, the vacuum head raised or lowered by vertically positioning the second section of the vacuum tube.

12. The carpet cleaning machine in claim 11 wherein the wheel assembly has a pair of wheels, each wheel rotatively mounted on opposite sides of a U-shaped wheel bar, a mounting means releasably connects the U-shaped wheel bar to the vacuum tube allowing the U-shaped wheel bar to be adjustably positioned on the vacuum tube.

13. The carpet cleaning machine in claim 12 further comprising a brush assembly, the brush assembly having a motor and a brush mounted behind the vacuum head, the brush rotatively mounted and coupled to the motor, the motor driving the brush to rotate.

14. The carpet cleaning machine in claim 13 wherein the motor rotates the brush at a rate of 1000 to 2000 RPM.

15. The carpet cleaning machine in claim 14 wherein the brush has bristles arranged in helical fashion across and around the brush.

16. The carpet cleaning machine in claim 15 further comprising a spray assembly, the spray assembly having a spray manifold, a plurality of spray heads emanating from the spray manifold, the spray heads positioned to deliver a pressurized stream of fluid at a location on the surface in between the vacuum head and the brush a fluid feeding tube extends from the spray manifold to a grip operated flow regulator, the grip operated flow regulator connected to a pressurized fluid source.

17. The carpet cleaning machine in claim 16 further comprising a handle assembly mounted onto the second section of the vacuum tube, the handle assembly having a grip portion capable of molding to the contours of a hand and a handle mounting means capable of releasably mounting onto the second section of the vacuum tube.

18. A prepackaged kit for retrofitting a carpet/floor cleaning wand having a vacuum tube and a vacuum head, the retrofit kit comprising a wheel assembly, the wheel assembly having a pair of wheels, each wheel rotatively mounted on opposite sides of a U-shaped wheel bar, a mounting means releasably connects the U-shaped wheel bar to the vacuum tube allowing the U-shaped wheel bar to be adjustably positioned on the vacuum tube, the wheel assembly providing a fulcrum upon which the vacuum head is raised or lowered onto a surface.

19. The prepackaged kit in claim 18 the kit further comprising a handle assembly, the handle assembly having a grip portion capable of molding to the contours of a hand and a handle mounting means capable of releasably mounting onto the vacuum tube.

20. The prepackaged kit in claim 18 the kit further comprising a brush assembly, the brush assembly having a motor and a brush mounted onto a brush assembly mounting means, the brush coupled to the motor, the motor driving the brush to rotate, the brush assembly mounting means mountable onto a vacuum head.

21. A carpet/floor cleaning wand for use with a carpet/floor cleaning machine, the carpet/floor cleaning wand comprising:

a vacuum tube, the vacuum tube having a first section extending roughly parallel to the ground and a second section angled in an upwards direction from the first section;

a vacuum head, the vacuum head connected to the vacuum tube and having a vacuum channel therein with an opening having bristles therearound and a squeegee mounted to the front of the vacuum head, the vacuum channel receiving vacuum pressure from the vacuum tube;

a brush assembly, the brush assembly having a motor and a brush mounted behind the vacuum head, the brush rotatively mounted and coupled to the motor, the motor driving the brush to rotate in a counter clockwise direction; and a spray assembly, the spray assembly having a spray manifold, a plurality of spray heads emanating from the spray manifold, the spray heads positioned to deliver a pressurized stream of fluid in between the vacuum head and the brush, a fluid feeding tube extends from the spray manifold to a grip operated flow regulator, a means for connecting the spray assembly to a pressurized fluid pump extending from the grip operated flow regulator.

22. The carpet/floor cleaning wand in claim 21 further comprising a wheel assembly the wheel assembly has a pair of wheels, each wheel rotatively mounted on opposite sides of a U-shaped wheel bar, a mounting means releasably connects the U-shaped wheel bar to the vacuum tube allowing the U-shaped wheel bar to be adjustably positioned on the vacuum tube.

* * * * *